United States Patent [19]

MacGregor

[11] Patent Number: 4,997,134

[45] Date of Patent: Mar. 5, 1991

[54] DOCUMENT SHREDDING MACHINE AND METHOD

[75] Inventor: Francis W. MacGregor, Simsbury, Conn.

[73] Assignee: Group Four Design, Avon, Conn.

[21] Appl. No.: 465,033

[22] Filed: Jan. 16, 1990

[51] Int. Cl.[5] ..... B02C 18/28

[52] U.S. Cl. ..... 241/3; 241/30; 241/236; 241/243; 241/280

[58] Field of Search ..... 29/4.51, 4.52, 4.53; 241/3, 30, 236, 235, 242, 243, 280, 281

[56] References Cited

U.S. PATENT DOCUMENTS

| | | | |
|---|---|---|---|
| 3,620,461 | 11/1971 | Pelleschl | 241/100 |
| 3,894,697 | 7/1975 | Lawson et al. | 241/159 |
| 4,068,805 | 1/1978 | Oswald | 241/159 |
| 4,124,169 | 11/1978 | Hatanaka | 241/101.4 |
| 4,257,565 | 3/1981 | Hatanaka | 241/100 |
| 4,330,092 | 5/1982 | Roman | 241/232 |
| 4,489,897 | 12/1984 | Turner et al. | 241/167 |
| 4,522,096 | 6/1985 | Niven, Jr. | 241/236 X |
| 4,627,582 | 12/1986 | Goldhammer | 241/236 |
| 4,919,345 | 4/1990 | Burlington et al. | 241/236 X |

*Primary Examiner*—Timothy V. Eley
*Attorney, Agent, or Firm*—McCormick, Paulding & Huber

[57] ABSTRACT

A document shredder for destroying a generally rectangular document and having feed rollers for engaging a marginal portion of a document and simultaneously spirally coiling the document into a generally cylindrical form while advancing the document in an axial direction. A rotary shredding mechanism cuts the leading end portion of the document as it is advanced by the feed rollers. The shredding mechanism may be arranged to cut the advancing document along a line of shear spaced inward of the leading edge of the leading end portion to trim successive strips from the leading end of the document. The shredding mechanism may also include chipping mechanism for reducing each strip to smaller bits as the strip is formed. The shredding mechanism may also include a rotary cutting element for cutting a series of generally parallel cuts in the document extending inward of the leading edge to form a succession of flag-like projections at the leading edge of the document which are thereafter sheared from the document by the shredding mechanism.

36 Claims, 4 Drawing Sheets

DOCUMENT SHREDDING MACHINE AND METHOD

BACKGROUND OF THE INVENTION

This invention relates in general to apparatus and method for destroying documents and the like and deals more particularly with an improved document shredding machine and method.

Machines for destroying classified documents and other confidential papers have gained widespread acceptance by government agencies, industry and business. However, the majority of these machines are large complex mechanisms designed for high speed operation to destroy large volumes of material and are relatively costly to produce. Such machines as have been provided for desktop operation are also relatively expensive to produce, require considerable desk space and do not adequately satisfy the need of the homeowner or small business establishment for an inexpensive compact machine suitable for light duty operation.

It is the general aim of the present invention to provide an improved document shredding method and an improved lightweight, compact, document shredding machine of simple durable construction which may be produced at low cost for light duty desktop operation.

SUMMARY OF THE INVENTION

In accordance with the present invention, there is provided an improved method and machine for shredding a generally rectangular document by simultaneously spirally coiling the document about an axis and advancing it in an axial direction while the leading end portion of the document is being cut.

DETAILED DESCRIPTION OF PREFERRED EMBODIMENT

Figure 1:
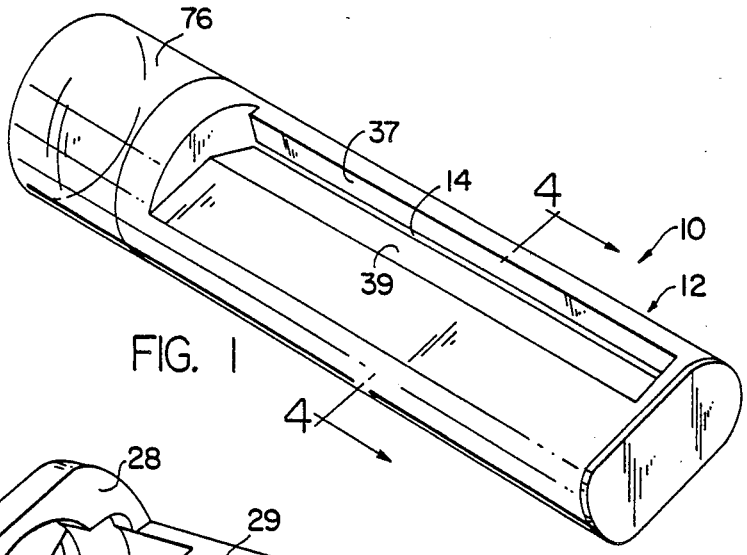
FIG. 1 is a perspective view of a document shredding machine embodying the present invention and used to shred a document in accordance with a method of the present invention.
Figure 2:
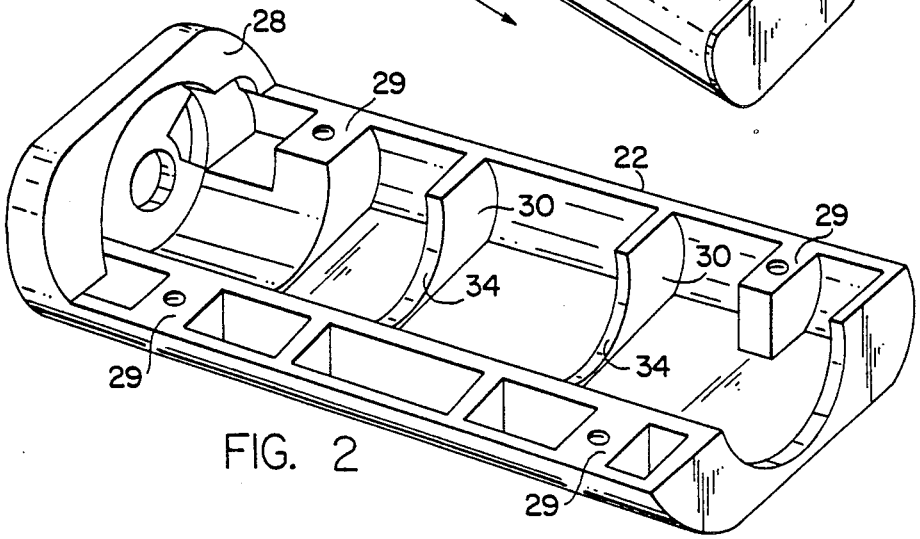
FIG. 2 is a perspective view of the upper section of the machine housing.
Figure 3:
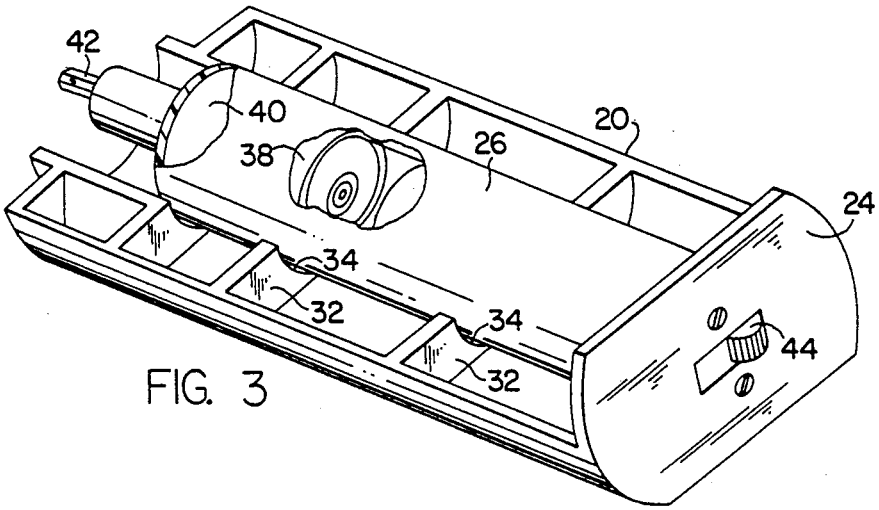
FIG. 3 is a perspective view of the lower section of the machine housing.

The drawings and the description which follows illustrate and describe document shredding machines embodying the present invention and for destroying a generally rectangular document in accordance with a method of the present invention. The machine indicated generally by the reference numeral 10 in FIGS. 1-6, is particularly adapted for light duty desktop operation and includes a housing, indicated generally at 12, having an inlet slot 14 communicating with the interior of the housing. A document to be destroyed is inserted into the inlet slot 14 and engages a feeding mechanism 16 located within the housing and shown in FIGS. 5 and 6. The feeding mechanism simultaneously spirally coils the document about an axis and advances it in an axial direction toward the front end of the machine and along a generally helical or spiral path. The document shredding mechanism includes a shearing mechanism, indicated generally at 18, and located within the housing near the front end of the slot 14. The shearing mechanism engages the leading end portion of the advancing document advanced by the feeding mechanism 16 and cuts successive pieces from it. Pieces cut from the advancing document are discharged from the shredding machine at the forward end of the housing 12, all of which will be hereinafter more fully described.

Considering the machine 10 in further detail the housing 12 may be made from any suitable material and may take various forms, but in accordance with one presently preferred construction it comprises a hollow thin walled clamshell structure molded from durable lightweight plastic material. The illustrated housing 12 includes a lower section 20 and an upper section 22. The lower section defines the housing bottom wall, portions of the housing side walls and a rear wall indicated at 24. A generally cylindrical tubular core 26 fastened or otherwise suitably secured to the rear wall 24 extends in an axially forward direction from it.

The upper section 22 defines the housing top wall, portions of the housing side walls and a front wall indicated at 28. The lower and upper sections 20 and 22 mate in assembly along a parting line which lies within an axial plane. A plurality of bosses 29, 29 formed on the upper section 22 threadably receive threaded fasteners (not shown) which extend upwardly through the housing bottom wall to retain the upper section in assembly with the lower section. A plurality of axially spaced apart radially disposed guide members or ribs 30, 30 and 32, 32 project inwardly toward the core from the upper and lower sections respectively, and cooperate in assembly to define a plurality of substantially circular guide surfaces 34 which generally coaxially surround associated peripheral portions of the core 26. Each circular guide surface 34 has a diameter somewhat larger than the outside diameter of the cylindrical core 26. Thus, an annular space 36 is defined between each guide surface 34 and an associated peripheral surface portion of the core 26, as best shown in FIG. 4.

Figure 4:
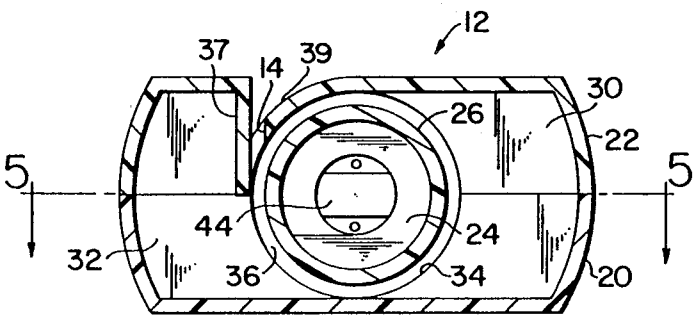
FIG. 4 is a somewhat enlarged axial sectional view taken along the line 4—4 of FIG. 1.

A vertically disposed wall 37 integrally formed on the upper section 22 cooperates with an arcuately downwardly curved portion of the housing top wall, indicated at 39, to define the slot 14 which opens through the upper surface of the upper section 22, as best shown in FIG. 4. The slot 14 is disposed in generally tangential relation to the cylindrical surface of the tubular core 26 and the guide surfaces 34, 34 and communicates with the annular spaces 36, 36 between the core 26 and the guide surfaces.

The drive mechanism for the document shredding machine 10 is preferably located within the core 26 and includes a reversible electric motor 38 which drives a conventional gear reduction unit 40. The gear reduction unit is located forward of the motor 38 and has a forwardly extending output shaft 42. The motor may be of AC or DC type, but preferably it is operated by 110 volt alternating current supplied through a conventional power supply or line cord (not shown). If a DC motor is employed, a suitable voltage converter may be provided and may also be located within the core 26. Operation of the motor 38 is controlled by a switch 44 mounted in the rear wall 24 and connected in series between the motor and the power supply source.

The presently preferred feed mechanism 16 comprises a pair of driven feed rollers. The feed rollers may take various forms and may, for example, comprise a pair of axially elongated rollers laterally offset from the core 26 and generally coextensive with the slot 14. However, the presently preferred feed mechanism includes a generally cylindrical main feed roller 46 made from DELRIN or a like material and mounted in fixed position on the output shaft 42. The main feed roller 46 is generally coaxially aligned with the core 26 and has a diameter equal to or slightly greater than the diameter of the core 26. A circumaxially spaced series of axially extending shallow grooves 48, 48 are formed in the cylindrical peripheral surface of the main feed roller 46 substantially as shown. The other feed roller, indicated at 50, is mounted in fixed position on a drive shaft 52 supported by the housing in parallel alignment with the output shaft 42. The roller 50 is preferably made from rubber or like resilient material and has at least one helical or spiral peripheral surface 54 disposed in engagement or near engagement with the peripheral surface cf the main feed roller 46. However, in accordance with the presently preferred construction two such spiral surfaces 54, 54 are provided on the roller 50. As viewed from the front the main feed roller 46 is driven in a counterclockwise direction, whereas the feed roller 50 is driven in a clockwise direction in timed relation to the main feed roller so that an in-running nip is formed between the two feed rollers whereby a document fed into the slot 14 enters the nip and is drawn downwardly through the slot and into the housing by the cooperating feed rollers 46 and 50.

A pair of circular cutting or shearing blades 56 and 58, which comprise the shearing mechanism 18, are supported within the housing 12 for rotation in overlapping shearing relation to each other as will be hereinafter further described. The peripheral surfaces of the cutters 56 and 58 preferably have a multiplicity of circumaxially arranged, closely spaced serrations therein, substantially as shown.

The rotary cutter 56 has a diameter substantially equal to the diameter of the main feed roller 46 and is secured in fixed position and coaxial relation to the frontal surface of the main teed roller 16 to rotate with it. The cutter 56 has a non-circular central opening for receiving an associated non-circular portion of the output shaft 42 therethrough. Thus, the main feed roller 46 and the cutter 56 are supported in fixed position on the output shaft 42 to rotate with the output shaft in response to operation of the motor 38.

Figure 5:
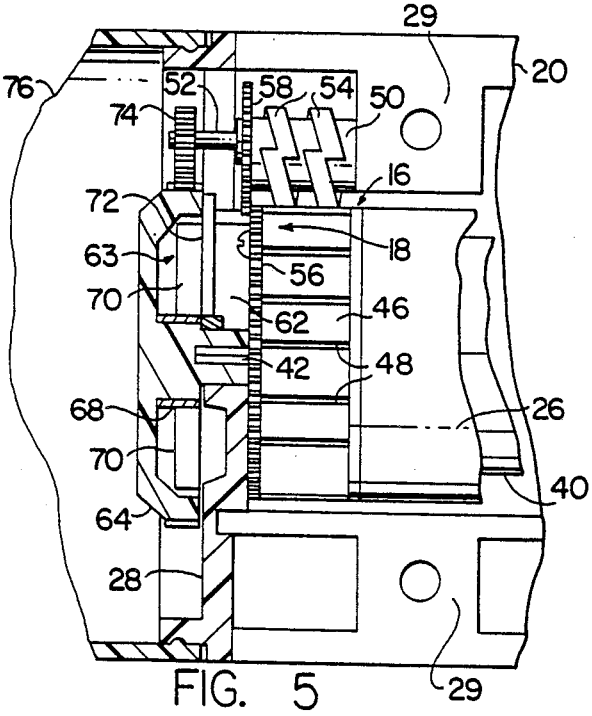
FIG. 5 is a somewhat further enlarged fragmentary axial sectional view taken along the line 5—5 of FIG. 4.

The circular cutter 58 is of somewhat smaller diameter than the cutter 56 and is supported in fixed position on the drive shaft 52 adjacent the forward end of the feed roller 50. The diameter of the cutter 58 is somewhat larger than the diameter of the feed roll 50 so that the cutter 58 is disposed in overlapping shearing relation with the peripheral edge portion of the cutter 56, substantially as shown in FIG. 5. A resilient wave or spring washer 60 received on the drive shaft 51 between the front wall 28 and the circular cutter 58 exerts a rearwardly directed biasing force upon the cutter 58 to maintain the overlapping peripheral edge portions of the serrated cutters 58 and 56 in substantial engagement with each other to provide an in-running shear point therebetween. An opening 62 is formed through the front wall 28 near the shear point between the cutters 56 and 58 for a reason which will be hereinafter apparent.

Figure 6:
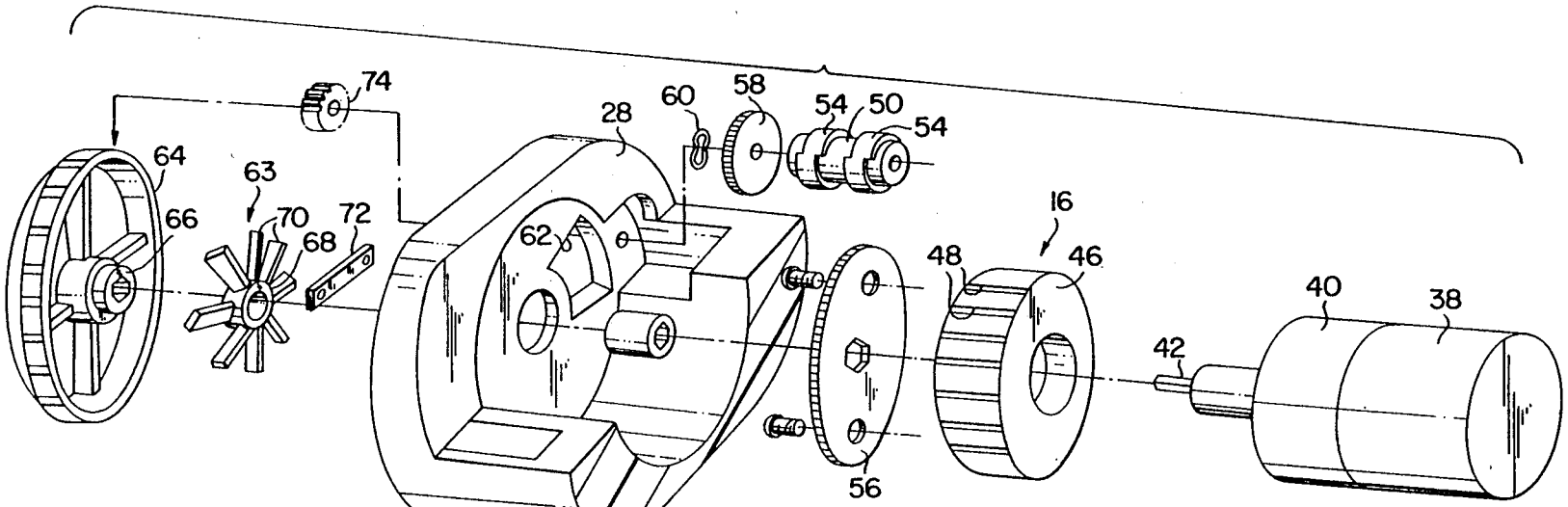
FIG. 6 is an exploded perspective view showing parts of the housing and the feeding and shredding mechanisms.

The document shredding mechanism further includes a chipping mechanism, indicated generally at 63, shown in FIGS. 5 & 6, and located forward of the front wall 28. The chipping mechanism includes a spoked gear 64 with a rearwardly projecting hub 66 which has a non-circular hub bore which receives a complementary non-circular portion of the output shaft 42 therein. Thus, the gear 64 is driven by the output shaft in unison with the main feed roller 46 and the circular cutter 56. A rotary chipper 68 having a plurality of radially outwardly extending blades 70, 70 and mounted in fixed position on the gear 64 rotates with the gear in response to operation of the drive motor 38. A stationary blade 72 mounted in fixed position on the front wall 28 near an associated edge of the opening 62 cooperates in shearing relation to successive blades 70, 70 on the rotary chipper 68 as the gear 64 rotates.

The drive shaft 52 is driven by a pinion 74 mounted in fixed position on it and disposed in meshing engagement with the gear 64. The illustrated shredder 10 has a cup shaped end cap 76 releasably retained in snap-on engagement with or otherwise secured to the forward end of the housing 12. The end cap is preferably made from transparent material, for a reason which will be hereinafter evident.

A generally rectangular document to be destroyed which may, for example, comprise a single sheet or a plurality of sheets of paper, is inserted into the document shredder 10 through the inlet slot 14 with a marginal portion of the document disposed at the forward end of the slot. As the forward marginal portion of the document enters the nip between the in-running feed rollers 46 and 50. The shallow grooves 48, 48 in the main feed roller cooperate with the resilient feed roller 50 to grip the document and draw it downwardly through the slot 14 and into the shredder housing 12. The guide surfaces 34, 34 cooperate with the peripheral surface of the core 26 to loosely coil the document about the core as it moves into the housing through the slot 14. The helical or spiral surfaces 54, 54 on the feed roller 50 simultaneously impart forward movement to the document to advance the document in an axially forward direction along a generally helical or spiral path and into the shear point between the rotary cutters 56 and 58 where a relatively narrow strip is sheared from the advancing marginal portion of the document.

Figure 7:
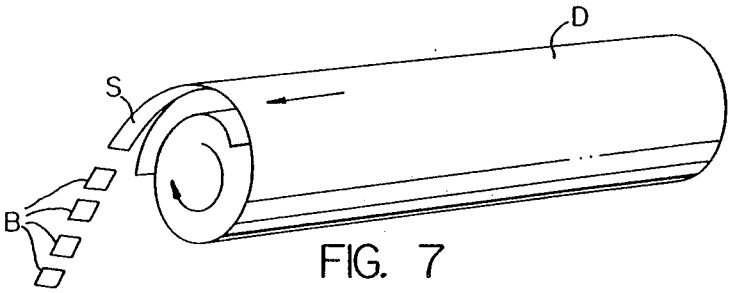
FIG. 7 is a somewhat schematic view illustrating a method for shredding a document.

The general posture of a document as it passes through the shredder is illustrated somewhat schematically in FIG. 7 where the document is indicated by the letter D. The strip separated from the forward marginal edge of the document D by the shearing mechanism 18 and indicated by the letter S, is directed through the opening 62 in the front wall. As the leading end of the strip S passes between the stationary shearing blade 72 and one of the blades 70 on the rotary chipper 68, a small bit of material is chopped from the leading end of the strip. The various mechanisms which comprise the shredder 10 are timed so that a small bit at the leading end of the strip S passes between the stationary chipping member 72 and each successive chipping blade 70 on the rotary chipper 68 as the strip S is advanced by the feeding mechanism 16. Thus, the shred or strip S formed by the shearing mechanism 18 is further shredded or reduced to small hits B, B by the chipping mechanism 63 as the document advances through the shredder 10. The resulting bits of paper B, B are received and contained within the end cap 76 which is preferably made from transparent material so that it will be readily apparent when emptying is required.

If a large number of documents are to be destroyed, the shredder 10 may be fitted with a tubular extension at its forward end. The shredder may then be positioned on a desk with the open end of the tubular extension overhanging an associated edge of the desk to discharge the resulting bits of paper B, B directly into a waste container or the like.

When properly operated, the document shredder 10 should provide trouble free service. However, the possibility that the machine 10 could be overloaded by the user is recognized and for this reason a reversible drive motor and an associated reversing switch may be provided to facilitate release cf material from the machine should jamming occur.

Figure 8:
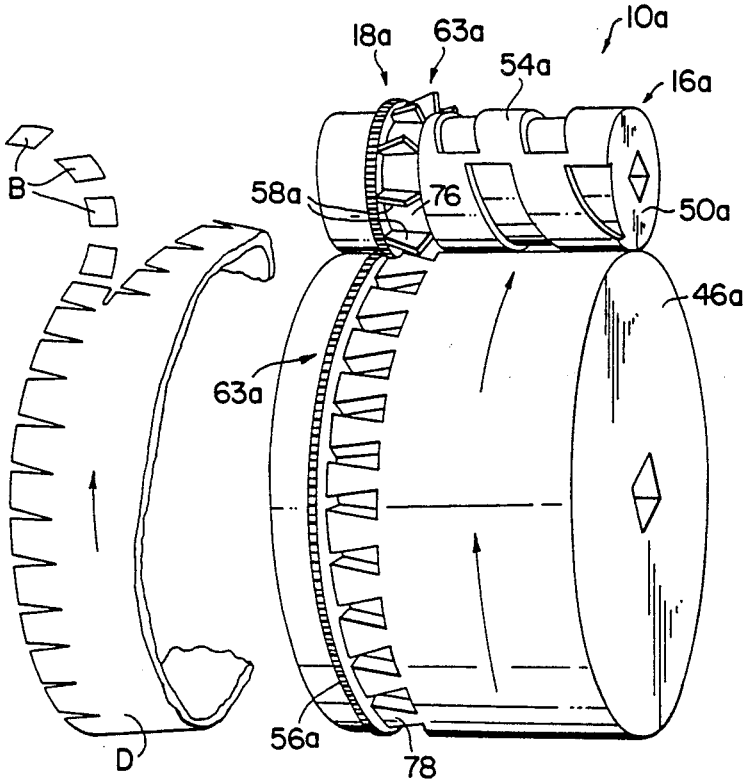
FIG. 8 is a fragmentary perspective view showing the feeding and shredding mechanism of another machine embodying the present invention and illustrating a method of the invention.

Referring now to FIG. 8, there is shown the feeding and shredding mechanism of another document shredding machine embodying the present invention and indicated generally at 10*a*. The machine 10*a* is similar in most respects to the machine 10, previously described, but differs therefrom in the construction and arrangement of the document shredding mechanism, therefore the other parts of the machine are not shown. The machine 10*a* has a document feeding mechanism indicated generally at 16*a* and similar to the feeding mechanism 16 previously described. The feeding mechanism includes a main feed roller 46*a* and another feed roller 50*a*. The roller 50*a* has at least one helical or spiral peripheral surface 54*a* which is disposed in engagement or near engagement with the peripheral surface of the main feed roller 46*a*, as previously discussed.

The shredding mechanism includes a piercing or punching mechanism indicated generally at 63*a* which has a rotary punch 77 and a cooperating rotary die 78 which, as shown, comprises an integral part of the main feed roller 46*a*. The shredding mechanism 63*a* further includes a shearing mechanism, indicated generally at 18*a* which has a pair of circular cutting or shearing blades 56*a* and 58*a* supported for rotation in overlapping shearing relation to each other. As in the previously described embodiment 10 the feeding mechanism 16*a* and the shredding mechanism 63*a* are driven in timed relation to each other. The drive mechanism (not shown) is or may be similar or substantially identical to the drive mechanism described with reference to the previous embodiment.

A document to be shredded and fed into the machine 10*a* engages the feeding mechanism 16*a* which spirally coils the document and advances it in the direction of the shredding mechanism. The leading marginal portion of the document first encounters the punching mechanism 63*a* which punches or shears the leading end portion of the advancing document to form a series of cuts in document which extend from the leading edge of the leading end portion of the document in the direction of the trailing edge of the document. As each cut is made a flag-like tab is produced on the leading end of the document, substantially as shown in FIG. 8 where the document is identified by the letter D. As the cut leading end portion of the document passes through the shearing mechanism 18*a* each of the flag-like tabs are cut from the document thereby reducing the document into small bits B, B which leave the machine 10*a* through a hole in the frontal wall of the housing (not shown) in the manner aforedescribed.

Figure 9:
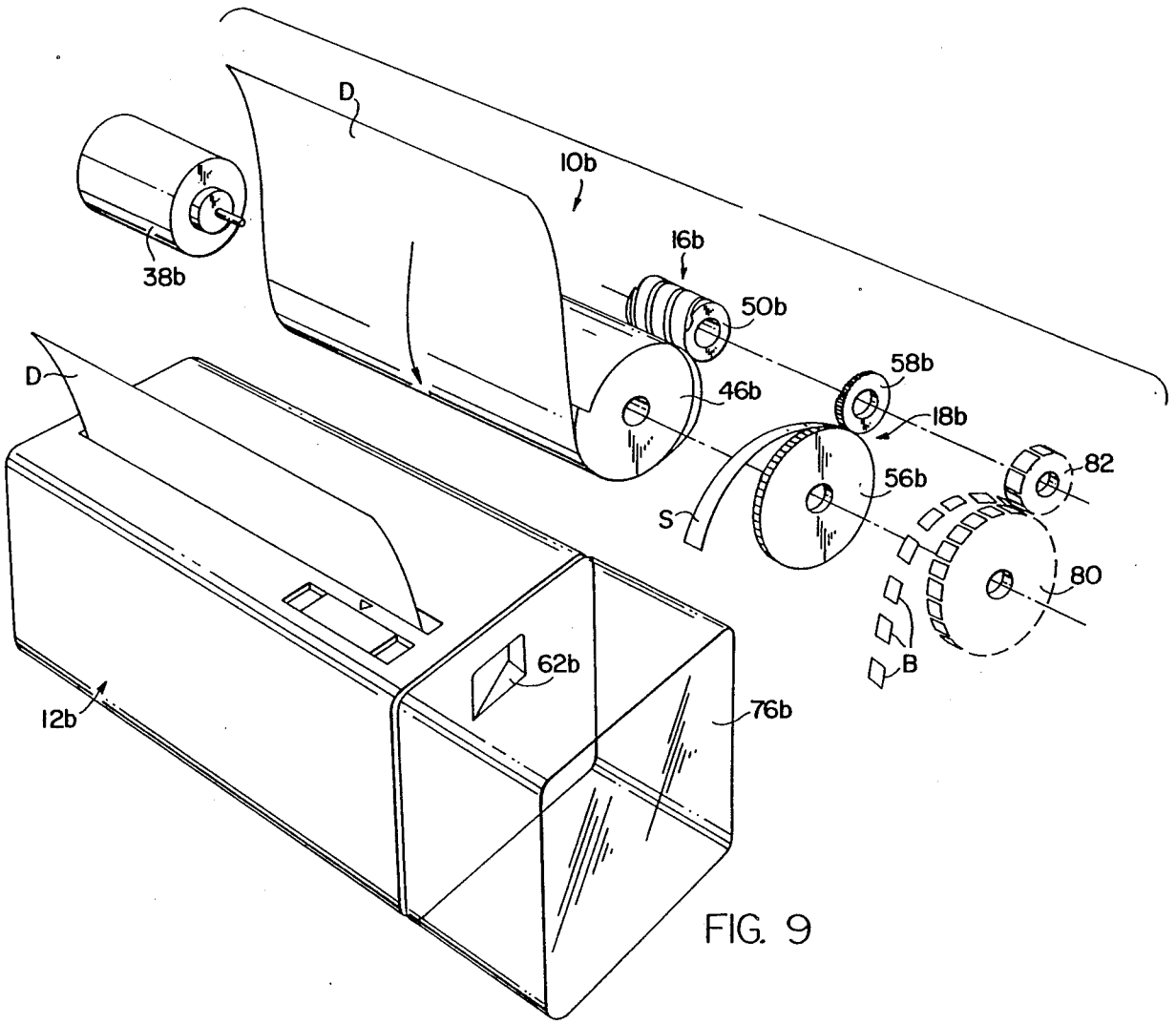
FIG. 9 is an exploded perspective view of another shredding machine embodying the invention and illustrating another method of the invention.

FIG. 9 further illustrates a modular concept of the present invention whereby a shredding machine may be produced in two basic models with a minimum of internal change. The illustrated machine, indicated generally by the reference numeral 10*b* has a housing 12*b* which is open at its front end to receive and contain the document feeding and shredding mechanism. The machine 10*b* has a first stage which includes a feeding mechanism 16*b* characterized by a spiral cylindrical feed roll 50*b* which cooperates with a main feed roll 16*b* to pull a sheet or document, such as the document D, into the machine, coil the document and advance it toward a shredder.

The shredder may simply comprise a shearing mechanism 18*b* which includes a pair of overlapping circular shearing disks, such as previously described, for trimming successive strips from the leading end portion of a coiled revolving paper document D as it advances. The feeding mechanism is preferably arranged to advance the spirally coiled paper document so that successive thin strips, approximately $\frac{1}{8}$ inch in width, are sheared from the leading end of the document until the document is totally destroyed. A simple machine of the aforedescribed type which includes only a feeding stage 16*b* and a shearing stage 18*b* may be adequate for most purposes, as for example, destroying paid household bills, business invoices and other obsolete documents.

If a higher degree of security is desired, a third stage may be added to the machine 10*b* immediately ahead of the second or shearing stage. Apparatus which comprises the third stage includes a pair of gear like wheels 80 and 82 which intermesh to chop each strip S formed by the shearing mechanism into smaller hits B, B which are expelled through an opening 62*b* in the front wall of the housing 12*b*, as previously discussed. It will now be apparent that most of the parts which comprise the machine 10*b* are common to both models thereby enabling a machine to be produced which will provide a desired degree of security at minimum cost by the simple expedient of adding or omitting parts.

I claim:

1. A method for shredding a document comprising the steps of simultaneously coiling the document about an axis and advancing the document in an axial direction, and cutting the leading edge portion of the document while it is being simultaneously coiled and advanced.

2. Method for shredding a generally rectangular document comprising the steps of spirally coiling the document about an axis, advancing the document in an axial direction, and shredding the document as it is advanced.

3. Method for shredding a generally rectangular document as set forth in claim 2 wherein the step of shredding is further characterized as shearing a strip from the leading end portion of the document.

4. Method for shredding a generally rectangular document as set forth in claim 3 wherein the step of shredding is further characterized as cutting the strip to reduce it to smaller hits as the strip is formed by the shredding means.

5. Method for shredding a generally rectangular document as set forth in claim 2 wherein the step of shredding is further characterized as cutting a series of slits in the leading end portion of the document extending inwardly in an axial direction from the leading marginal edge of the document to form a series of flag like portions along the leading end portion of the document.

6. Method for shredding a generally rectangular document as set forth in claim 5 wherein the step of shredding is further characterized as shearing the flag-like portions from the leading end portion of the document.

7. A method for shredding a sheet of paper comprising the steps of simultaneously spirally coiling the sheet about an axis while rotating the sheet about the axis and advancing the leading edge of the sheet along a generally helical path, and shredding the sheet by shearing it inwardly of the leading edge and along a line of shear generally parallel to the leading edge to separate successive strips from the leading portions of the sheet.

8. A method for shredding a sheet of paper as set forth in claim 7 wherein the step of shredding includes the additional step of cutting the advancing sheet along successive generally parallel lines of cut extending from the leading edge of the sheet in a generally rearward direction.

9. A method for shredding a sheet of paper as set forth in claim 8 wherein the step of cutting is performed before the step of shearing.

10. A document shredder comprising feeding means for simultaneously spirally coiling a generally rectangular document about an axis and advancing the document in an axial direction, and shredding means for cutting the leading end portion of the spirally coiled document as it is advanced by the feeding means.

11. A document shredder as set forth in claim 10 wherein said shredding means is further characterized as means for cutting successive strips from said leading end portion.

12. A document shredder as set forth in claim 11 wherein said shredding means comprises rotary shearing means.

13. A document shredder as set forth in claim 12 wherein said rotary shearing means comprises a pair of rotary cutters journalled for rotation in overlapping relation to each other.

14. A document shredder as set forth in claim 11 wherein said shredding means is further characterized as means for cutting each successive strip into a succession of smaller bits.

15. A document shredder as set forth in claim 14 wherein said shredding means comprises a pair of circular cutters journalled for rotation in overlapping relation to each other.

16. A document shredder as set forth in claim 15 wherein said shredding means further includes a stationary cutting blade and a rotary spoked cutter journalled for rotation in shearing relation to said stationary cutting blade.

17. A document shredder as set forth in claim 10 wherein said shredding means comprises a part of said feeding means.

18. A document shredder as set forth in claim 10 wherein said shredding means comprises means for cutting a succession of slits in said leading end portion of the document extending in generally axial directions from the leading edge of said document across the leading end portion of the document and toward the trailing edge thereof.

19. A document shredder as set forth in claim 18 wherein said shredding means comprises part of said feeding means.

20. A document shredder as set forth in claim 19 wherein said feeding means is further characterized as rotary feeding means.

21. A document shredder as set forth in claim 20 wherein said rotary feeding means comprises a pair of feed rollers and said shearing means include rotary punching means carried by one of said feed rollers and rotary die means associated with the other of said feed rollers for cooperating in shearing relation with said rotary punching means.

22. A document shredder as set forth in claim 10 wherein said feeding means comprises rotary feeding means.

23. A document shredder as set forth in claim 22 wherein said rotary feeding means comprises a pair of feed rollers journalled for rotation about generally parallel axes for engaging opposite sides of a document received therebetween.

24. A document shredder as set forth in claim 23 wherein at least one of said rollers has a helical surface portion.

25. A document shredder as set forth in claim 10 including a housing having a slot therein communicating with the interior thereof and said feeding means is located within said housing proximate one end of said slot.

26. A document shredder as set forth in claim 25 wherein said feeding means includes means for guiding a document along a generally cylindrical path as it is spirally coiled by said feeding means.

27. A document shredder as set forth in claim 17 wherein said guiding means includes a generally cylindrical core supported within said housing and means defining a generally circular guide surface coaxially surrounding an associated portion of said core in radially outwardly spaced relation to said core and cooperating with said core to define and annular space and said slot communicates with said annular space.

28. A document shredder as set forth in claim 18 including driving means disposed within said core for driving said feeding means and said shearing means in timed relation to each other.

29. A document shredder as set forth in claim 19 wherein said driving means comprises a motor disposed within said core.

30. A document shredder as set forth in claim 28 wherein said driving means comprises an electrically operated motor and a reduction unit driven by said motor and drivingly connected to said feeding means and said shearing means.

31. A document shredder comprising an axially elongated hollow housing, a cylindrical tubular core supported within said housing, guide means on said housing cooperating with said core to define an annular space generally coaxially surrounding an associated portion of the peripheral surface of said core, means defining a slot in said housing communicating with said annular space and disposed in a generally tangential relation to said peripheral surface, feeding means for engaging a marginal portion of a document inserted into said slot and drawing the document into said housing and simultaneously spirally coiling the document about said core and advancing the document in an axial direction, and rotary shredding means disposed within said housing in the path of the advancing document for cutting the leading end portion of the advancing document.

32. A document shredder as set forth in claim 31 including a motor contained within said tubular core and operably connected to said feeding means and said shredding means for driving the latter means in timed relation to each other.

33. A document shredder as set forth in claim 32 including a gear reduction unit connecting said motor to said feeding means and said shredding means.

34. A document shredder comprising a hollow housing, a tubular core supported within said housing, means on said housing cooperating with the outer surface of said tubular core to define an annular space, an outwardly opening slot in said housing communicating with said annular space, rotary feeding means disposed within said housing near the forward end of said slot for receiving a document inserted into said housing through said slot and simultaneously spirally coiling the document within said annular space and about said tubular core and advancing the document toward the forward end of said housing and including a pair of feeding rollers for engaging opposite sides of a document inserted into said slot, at least one of said feeding rollers having a helical surface portion, shredding means disposed in the path of a document advanced by said feeding means, means for shredding a document advanced by said feeding means and including a pair of rotary shearing members for cutting a strip from the leading end portion of the document, and a drive means contained within said core and operably connected to said feeding means and said shearing means for driving the latter means in timed relation to each other.

35. A document shredder as set forth in claim 34 wherein said shredding means further comprises means for cutting the strip into a succession of smaller bits.

36. A document shredder comprising a hollow housing, a generally cylindrical tubular core coaxially supported within said housing, a plurality of axially spaced apart ribs on said housing cooperating with the outer surface of said tubular core to define a plurality of annular spaces between said ribs and said core, means defining an elongated outwardly opening slot in said housing extending in a direction generally parallel to the axis of said core and opening into said annular spaces in generally tangential relation to the surface of said core for receiving a document inserted into said housing through said slot, feeding means disposed within said housing near the forward end of said slot for engaging a document inserted into said slot and simultaneously drawing the document into said housing and spirally coiling it about said core while advancing it in an axially forward direction and including a main drive roller supported for coaxial rotation relative to said core, said main drive roller having a diameter at least as large as the diameter as said core, and another drive roller supported on said housing for rotation relative to said main drive roller and cooperating with said main drive roller to define an in-running nip therebetween, shredding means for cutting a strip from the forward end portion of a document advanced by said feeding means and including a pair of rotary shearing members, one of said shearing members being supported for coaxial rotation in unison with said main feed roller, the other of said shearing members being supported for coaxial rotation with said other feed roller, said shearing members being disposed in overlapping shearing relation to each other to define an in-running nip therebetween, and drive means for operating said feeding means and said shredding means.

* * * * *